United States Patent [19]

Matsui et al.

[11] 4,409,448

[45] Oct. 11, 1983

[54] PULL-PUSH SWITCH

[75] Inventors: Hiroshi Matsui, Hirakata; Kazuo Sakami, Kobe; Matsuo Nishioka, Hirakata; Takashi Onizawa, Sakai, all of Japan

[73] Assignee: Matsushita Electric Industrial Co., Ltd., Osaka, Japan

[21] Appl. No.: 316,283

[22] Filed: Oct. 29, 1981

[30] Foreign Application Priority Data

Oct. 31, 1980 [JP] Japan ..... 55/156665[U]
May 20, 1981 [JP] Japan ..... 56/73572[U]

[51] Int. Cl.[3] ..... H01H 5/20

[52] U.S. Cl. ..... 200/153 LA; 200/68; 200/156; 338/172; 338/198; 338/200

[58] Field of Search ..... 200/153 LA, 156, 275, 200/324, 328, 159 A, 64, 68, 77, 67 G; 338/172, 179, 198, 200

[56] References Cited

U.S. PATENT DOCUMENTS

| | | | |
|---|---|---|---|
| 2,453,231 | 11/1948 | Kavanagh | 200/156 |
| 2,999,991 | 9/1961 | Bender | 338/172 X |
| 3,219,776 | 11/1965 | Yerkovich | 200/159 A |
| 3,236,971 | 2/1966 | Cetsworth | 338/172 X |
| 3,459,913 | 8/1969 | Mutschler et al. | 200/156 |
| 4,339,643 | 7/1982 | Murmann | 200/153 LA X |

*Primary Examiner*—John W. Shepperd
*Assistant Examiner*—Renee S. Kidorf
*Attorney, Agent, or Firm*—Burgess, Ryan and Wayne

[57] ABSTRACT

A pull-push switch has one or two stationary contacts and one U-shaped elastic movable contact with two legs which, when not deformed, are adapted to resiliently make into contact with the stationary contacts. A cam is securely mounted on an operating shaft which can be axially shifted between the pulled and pushed positions. The cam has a small-diameter cylindrical portion contiguous with a tapered intermediate portion which in turn is contiguous also with a large-diameter cylindrical portion. The legs of the elastic movable contact are so positioned that they are normally maintained in contact with the peripheral surface of the cam as it is shifted in unison with the operating shaft so that when the shaft is pushed or pulled, the legs of the elastic movable contact rest on the small-diameter cylindrical portion of the cam and subsequently make contact with the stationary contacts, whereby the switch is closed. When the operating shaft is pulled or pushed, the legs of the elastic movable contact ride on the large-diameter cylindrical portion of the cam so that they are forced to bend outward or moved away from each other and from the stationary contacts and consequently the switch is opened.

7 Claims, 16 Drawing Figures

PULL-PUSH SWITCH

BACKGROUND OF THE INVENTION

The present invention relates to a pull-push switch which is adapted to be used especially in combination with a rotary type variable resistor or the like.

The prior art pull-push switch has the following problems or defects:

(1) It comprises a large number of component parts.
(2) As a result, many fabrication and assembly steps are needed.
(3) Therefore, the costs are high.
(4) The overall axial length is long.
(5) When combined or ganged with other pull-push switches, an interface-like component must be interposed between them. This is disadvantageous to the fabrication and applications.

SUMMARY OF THE INVENTION

One of the objects of the present invention is, therefore, to provide a pull-push switch which can be opened or closed by pushing or pulling an operating shaft and which can be easily combined or ganged with other types of push-pull switches.

Another object of the present invention is to provide a pull-push switch which can be fabricated with a minimum number of component parts and compact in size and a less cost.

A further object of the present invention is to provide a pull-push switch which can be securely maintained in the opened or closed state.

To the above and other ends, the present invention provides a pull-push switch which has one or two stationary contacts and one U-shaped elastic movable contact with two legs which are maintained in contact with the stationary contacts when exerted with no external force. A cam is securely mounted on an operating shaft which can be axially shifted between the pulled and pushed positions. The cam has a small-diameter cylindrical portion contiguous with a tapered intermediate portion which in turn is contiguous also with a larger-diameter cylindrical portion. The legs of the elastic movable contact are so positioned that they are normally maintained in contact with the peripheral surface of the cam as it is shifted in unison with the operating shaft so that when the shaft is pushed or pulled, the legs of the elastic movable contact rest on the small-diameter cylindrical portion of the cam and subsequently make contact with the stationary contacts, whereby the switch is closed. When the operating shaft is pulled or pushed, the legs of the elastic movable contact ride past the tapered intermediate portion and rest on the large-diameter cylindrical portion of the cam. As a result, they are forced to bend outward or to be moved away from each other and from the stationary contacts and consequently the switch is opened.

BRIEF DESCRIPTION OF THE DRAWINGS

Same reference numerals are used to designate similar parts throughout the figures.

DETAILED DESCRIPTION OF THE PRIOR ART

Figure 1:
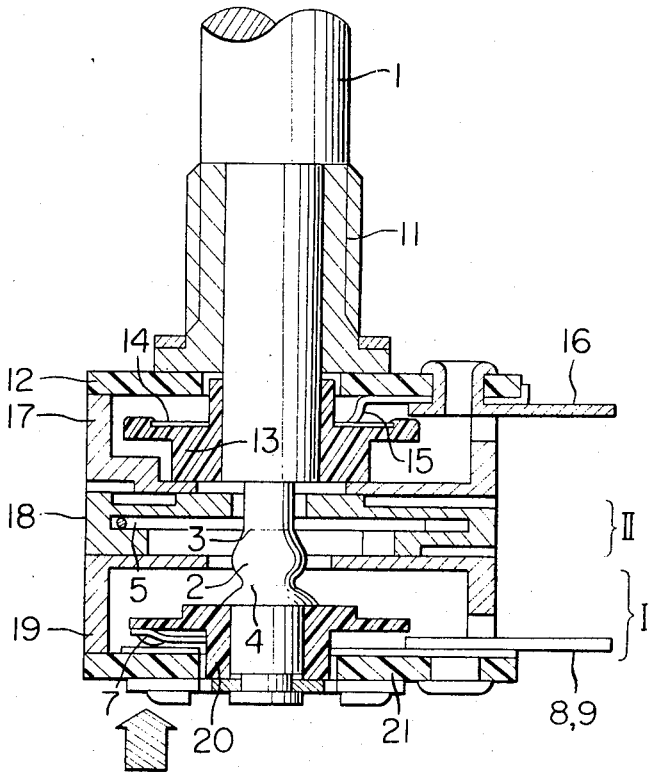
FIG. 1 PRIOR ART
FIG. 1 is a longitudinal sectional view of a prior art pull-push switch combined or ganged with a rotary type variable resistor.
Figure 2:
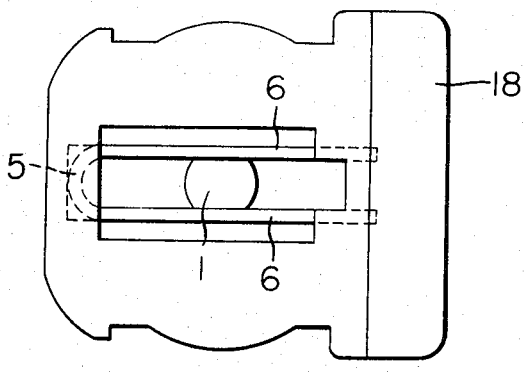
FIG. 2 PRIOR ART
FIG. 2 is a top view thereof with the variable resistor removed.

In FIGS. 1 and 2 is shown a prior art pull-push switch combined with a rotary variable resistor. An operating shaft 1 has a barrel-like bulged portion 2 contiguous with upper and lower reduced diameter portions 3 and 4. An elongated U-shaped locking spring 5 is disposed within a casing 18 perpendicular to the operating shaft 1 in such a way that its legs 6 clamp the reduced diameter portion 3 or 4. When the operating shaft 1 is pulled from the position as shown in FIG. 1, the bulged portion 2 expands the legs 6 of the locking spring 5 outward and when it passes through the legs 6, the latter spring back to their initial positions, clamping the lower reduced diameter portion 4. As a consequence, the operating shaft 1 is locked. As the operating shaft 1 is shifted to the pulled position, a movable contact 7 which is electrically connected in series between stationary contacts 8 and 9 breaks the electrical connection between the stationary contacts 8 and 9.

Figure 3:
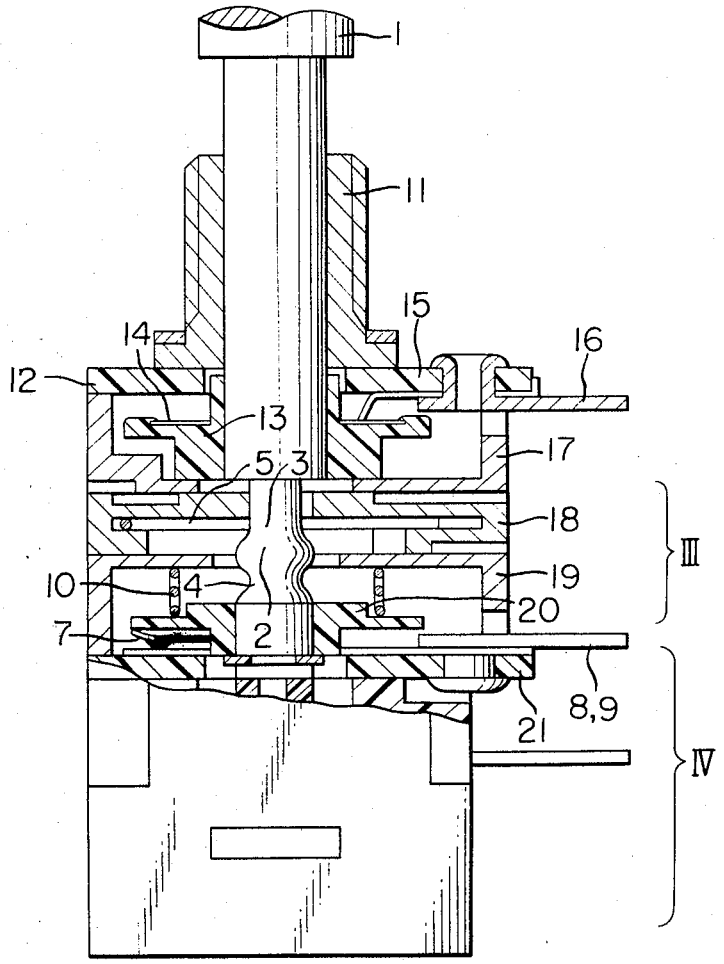
FIG. 3 PRIOR ART
FIG. 3 is a longitudinal sectional view of a combination of the prior art pull-push switches of the type shown in FIG. 1.
Figure 4:
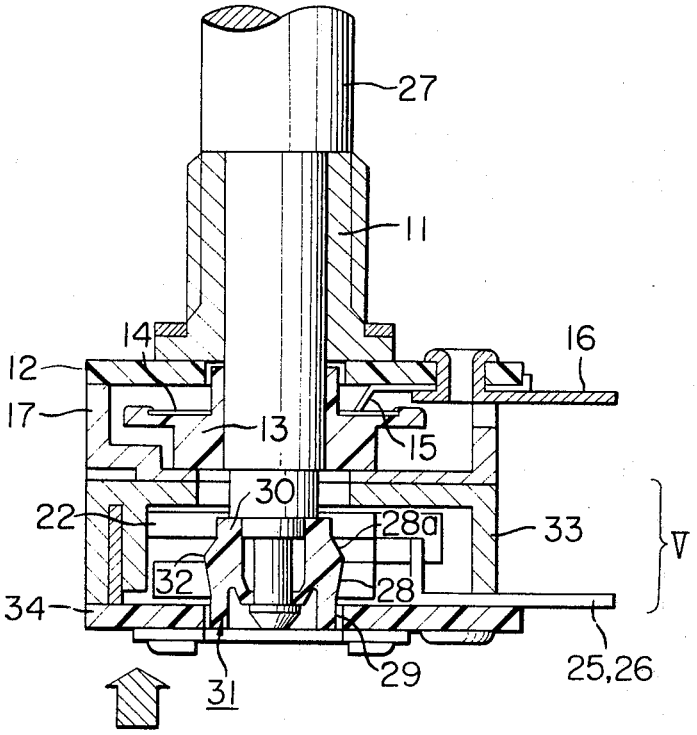
FIG. 4 is a longitudinal sectional view of a first embodiment of the present invention which is combined or ganged with a rotary type variable resistor.

In FIGS. 1 to 3, reference numeral 11 designates a bearing; 12, a base upon which is mounted a resistor (not shown); 13, a brush holder securely fitted over the operating shaft 1 for rotation in unison therewith; 14, a brush which is mounted on the brush holder 13 and whose leading end slides over the resistor when the operating shaft 1 is rotated; 15, a contact which is mounted on the base 12 and is maintained in normal contact with the brush 14 and an intermediate terminal 16; 17, a casing for the variable resistor; 18, the casing for the locking mechanism or unit; 19, a casing for the switch; 20, a driving disk which is securely attached to the lower end of the operating shaft 1 for rotation in unison therewith so as to drive the movable contact 7; and 21, a bottom plate upon which are attached the terminals 8 and 9. The movable contact 7 and the terminals 8 and 9 form a switch I.

The pull-push switch of the type as shown in FIGS. 1 and 2 has the locking unit II comprising the bulged portion 2 of the operating shaft 1, the reduced diameter portions 3 and 4 contiguous therewith and the locking spring 5. Therefore, it has the defects described previously.

In FIG. 3 is shown in longitudinal section a ganged switch comprising a pull-push switch III of the type described above and another pull-push switch IV of the same type. This type of switch has a disadvantage that an auxiliary spring 10 must be added so as to hold the contact of the switch III at a predetermined position independent of the pushing action of the switch IV.

When the operating shaft 1 is pushed, the push-pull switch IV is closed or opened and remains in the closed or opened position even when the pushing force is relieved from the operating shaft. When the operating shaft 1 is pushed again, the switch IV is opened or closed and remains in the opened or closed position even when the pushing force is relieved.

The Invention

The present invention was made to solve the above and other problems encountered in the prior art pull-push switch and will become more apparent from the following description of preferred embodiments thereof with reference to FIGS. 4 to 16.

First Embodiment, FIGS. 4 to 9

Figure 5:
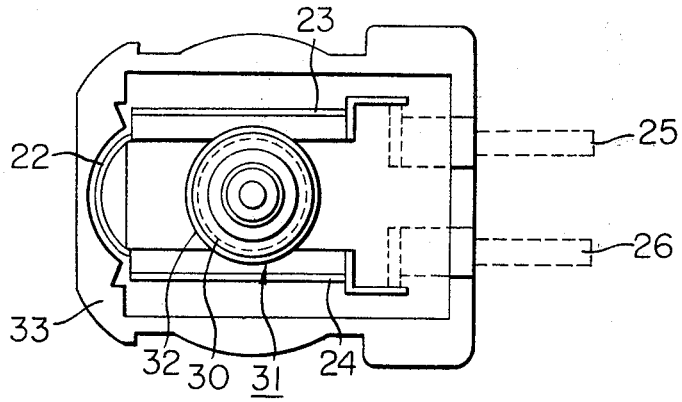
FIG. 5 is a top view thereof with the variable resistor removed.

In FIGS. 4 to 7 is shown in detail a pull-push switch in accordance with the present invention which is generally designated by V. A U-shaped movable contact member 22 is made of a spring material and has two legs 23 and 24. When the legs 23 and 24 are in their normal positions as shown in FIG. 5, they are made into contact with stationary contacts or terminals 25 and 26, respectively, whereby the electrical connections between the terminals 25 and 26 can be established and maintained.

A cam 31 which is made of an electrically insulating material is securely fitted over the operating shaft 27 adjacent to its lower end for vertical movement and rotation in unison therewith. The cam 31 is formed with a lower cylindrical portion 29 (to be referred to as "the lower large-diameter portion"), an inverted frustoconical portion 28 adjacent to the lower large-diameter portion 29, a frustoconical portion **28*a* adjacent to the inverted frustoconical portion 28 and an upper cylindrical portion 30 (to be referred to as "the upper small-diameter portion"). The portions 28 and 28*a* are on both sides of a center large-diameter portion 32 respectively. These portions 29, 28, 28*a* and 30 are coaxial with each other and with the operating shaft 27. As best shown in FIG. 6 or 7, the cam 31 is spaced apart from the inner ends of the stationary contacts 25 and 26 and is clamped by the legs 23 and 24 of the U-shaped movable contact 22**.

Figure 6A:
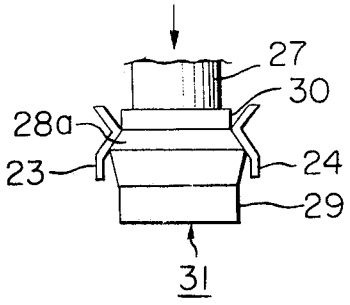
FIGS. 6A and 6B are views used to explain the mode of operation thereof.
Figure 7:
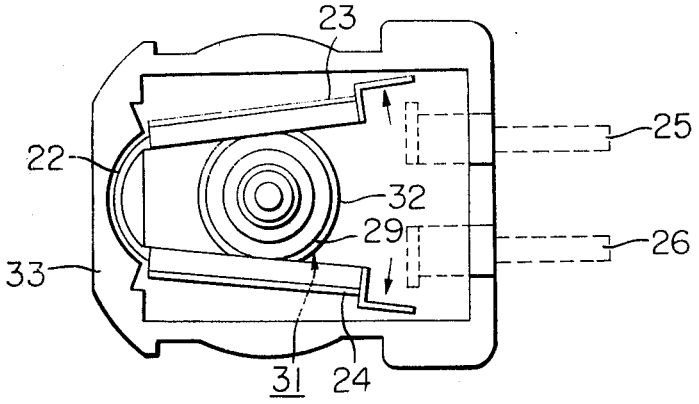
FIG. 7 is a view similar to FIG. 5 but shows the switch in the opened state.

When the operating shaft 27 is pushed down, the legs 23 and 24 of the movable contact 22 clamp the upper small-diameter portion 30 of the cam 31 as best shown in FIG. 6A. To put into another way, the legs 23 and 24 are maintained in their normal or initial positions so that they are maintained in contact with the stationary contacts or terminals 25 and 26, respectively, as best shown in FIG. 5. Therefore, the diameter of the upper small-diameter portion 30 of the cam 31 is so selected that the above described condition can be attained. Alternatively, the diameter of the small-diameter portion 30 can be made smaller than the distance between the legs 23 and 24 in their normal or initial positions so that when the legs 23 and 24 are in contact with the stationary contacts or terminals 25 and 26, the small-diameter portion 30 of the cam 31 is spaced apart from the legs 23 and 24.

Figure 6B:
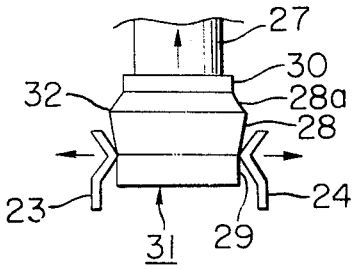

On the other hand, when the operating shaft 27 is pulled up, the legs 23 and 24 are forced to expand outwardly and finally made into contact with the large-diameter portion 29 of the cam 31 as best shown in FIG. 6B. The diameter of the large-diameter portion 29 is so selected that when the legs 23 and 24 are maintained in their outwardly extended positions, they are moved away from the stationary contacts or terminals 25 and 26 as best shown in FIG. 7. In other words, the diameter of the lower large-diameter portion 29 of the cam 31 is greater than the distance between the legs 23 and 24 in their normal positions.

The operating shaft 27 must be pulled against the force of the elastic movable contact 22. To put into another way, the operating shaft 1 can be securely maintained in the closed position in which the legs 23 and 24 of the movable contact 22 are made into contact with the stationary contacts or terminals 25 and 26 as described above. As a result, an erratic opening of the switch V due to vibration or the like can be avoided.

As best shown in FIGS. 6A and 6B, the legs 23 and 24 of the elastic movable contact member 22 are bent in the form of V in cross section so that the bottom edges of the legs 23 and 24 are made into line contact with the cam 31. In addition, the upper small-diameter portion 30 of the cam 31 is contiguous with the frustoconical portion **28*a* which gradually diverges downward and then is contiguous with the inverted frustoconical portion 28 which gradually converges downward and is adjacent to the lower large-diameter portion 29. Therefore, the legs 23 and 24 of the movable contact member 22 can be gradually and smoothly moved toward or away from each other as the operating shaft 1** is pulled or pushed.

Referring back to FIG. 4, the pull-push switch V is housed in a casing 33 which in turn is securely joined to the bottom of the casing 17 of the variable resistor by suitable means. For instance, lugs or the like are struck out of the bottom of the casing 17, inserted into mating holes formed through the top of the casing 33 and bent to clinch against it. The stationary contacts or terminals 25 and 26 are mounted on a base 34 and extended out of the casing 33.

Figure 8:
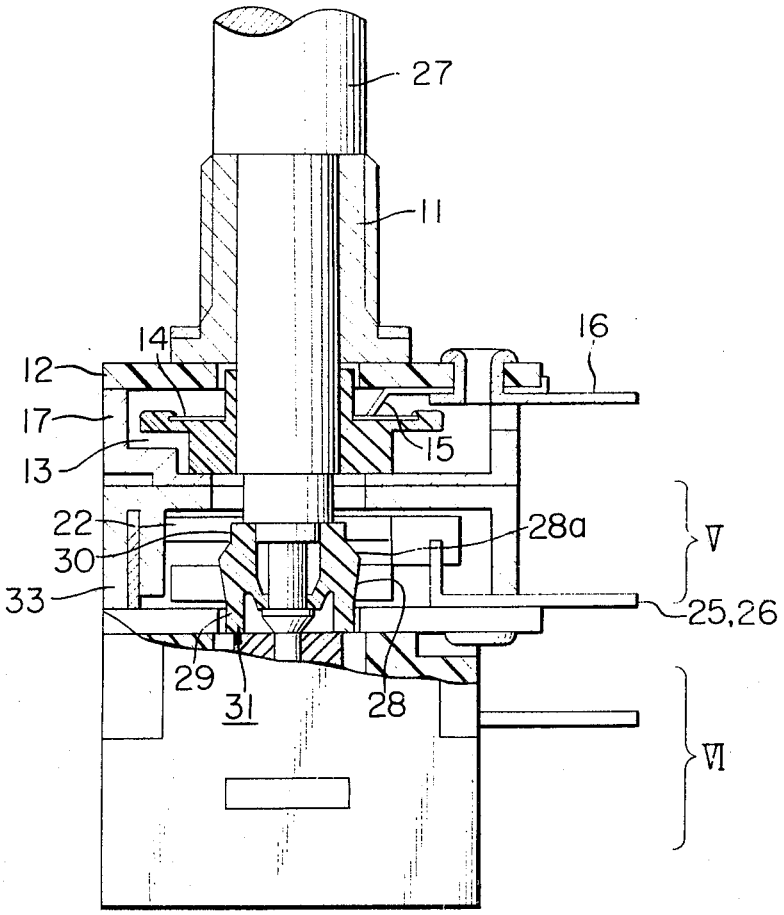
FIG. 8 shows the first embodiment combined or ganged with another pull-push switch.

The pull-push switch V of the type described above with reference to FIGS. 4 to 7 can be combined or ganged with another pull-push switch generally indicated by the reference numeral VI as shown in FIG. 8. In the pull-push switch V, the elastic movable contact member 22 also serves as the locking means as described previously so that the auxiliary spring 10 used in the prior art ganged switch (See FIG. 3) can be eliminated. It only suffices to connect the lower end of the operating shaft 27 of the switch V to the upper end of the operating shaft of the pull-push switch VI. The pull-push switch VI does not constitute the present invention so that no detailed description thereof shall be made in this specification. For instance, it may be of the type described with reference to FIG. 3. That is, it is closed or opened as the operating shaft 27 of the pull-push switch V is pushed or pulled.

Figure 9:
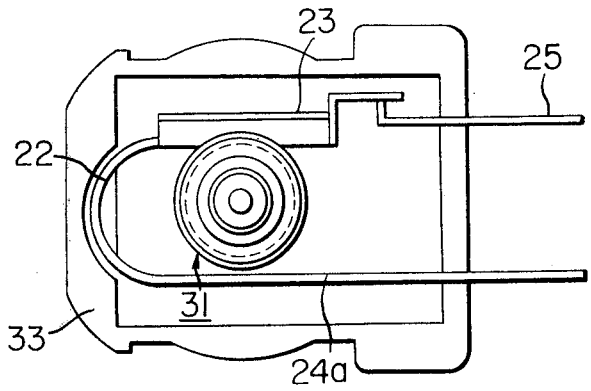
FIG. 9 is a view similar to FIG. 5 but shows a modification of the first embodiment.

In FIG. 9 is shown a modification of the first embodiment. One leg **24*a* of the elastic movable contact member 22 is extended out of the casing 33 and used as the stationary contact or terminal 26 of the switch V shown in FIGS. 4 and 7**. Therefore, the pull-push switch can be made simple in construction and subsequently fabrication.

Second Embodiment, FIGS. 10 to 15

The pull-push switches of the type described above are most frequently combined with rotary type variable resistors. When the operating shaft 27 is rotated to rotate the wiper or the like of the variable resistor, small vibraton or impact tends to be exerted to the shaft 27 in the axial direction thereof and consequently the shaft 27 is caused to move axially. If the operating shaft 27 is forced to move upwardly from the closed position (See FIG. 6A), the legs 23 and 24 ride over the conically tapered portion 28*a* so that they are moved away from each other and hence from the stationary contacts or terminals 25 and 26. As a result, the pull-push switch V is erratically opened. A second embodiment of the present invention was made to overcome this problem.

Figure 10:
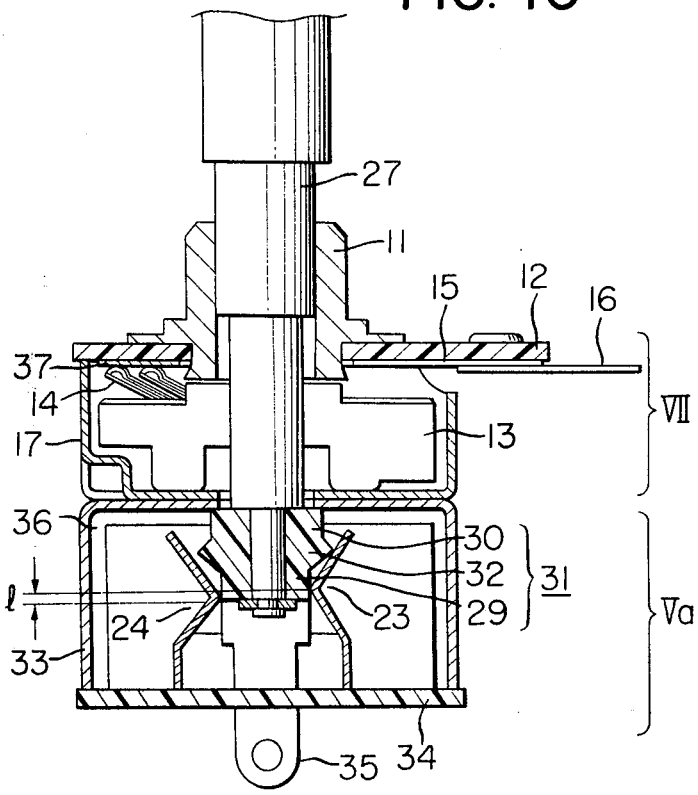
FIG. 10 is a longitudinal sectional view of a second embodiment of the present invention combined or ganged with a rotary type variable resistor.
Figure 11:
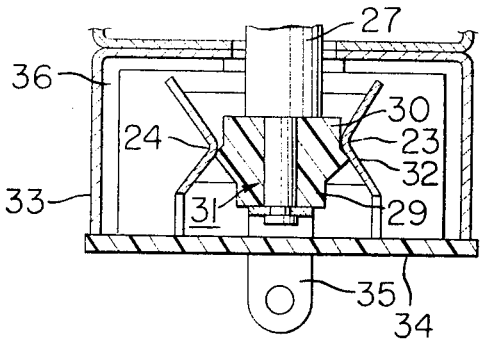
FIG. 11 is a view similar to FIG. 10 but shows the switch in the opened state.

Referring particularly to FIGS. 10 and 11, in the second embodiment the switch is opened when the operating shaft 27 is pushed in, but when the shaft 27 is pulled out the switch Va is closed. That is, the action of the second embodiment is reversal of that of the first embodiment. Therefore, the cam 31 is inverted in the second embodiment. More specifically, the upper cylindrical portion 30 is greater in diameter than the lower cylindrical portion 29. In addition, one of the legs 23 and 24 is extended as shown in FIG. 9 and used as one of the stationary contacts or terminals 25 and 26 though not specifically shown in FIG. 10 or 11. Furthermore, a stationary contact 35 is interposed between the legs 23 and 24. Moreover, the inside walls of the casing 33 are lined with insulating covers 36. Reference numeral 34 designates an end plate and 37 designates a resistor of the rotary type variable resistor VII.

In the second embodiment, the legs 23 and 24 of the elastic movable contact member 22 are staggered in the vertical or axial direction. More specifically, the edge of the leg 23 is vertically or axially spaced apart by a distance l from the edge of the leg 24.

With the operating shaft 27 in the pulled position, the leg 23 is made into contact with the small-diameter portion 29 of the cam 31 as shown in FIG. 10 while the ridge of the leg 24 is made into contact with the stationary contact 35 under a suitable pressure, whereby the switch Va is closed.

The distance of vertical or axial misalignment between the edges of the legs 23 and 24 is so determined as to satisfy the following conditions. With the switch closed or the operating shaft 27 in the pulled position, only the leg 23 must be maintained in contact with the small-diameter portion 29 of the cam 31. With the switch in the opened state; that is, the operating shaft 27 in the pushed position, the leg 24 must be maintained in contact with the large-diameter portion 30 of the cam 31 so that both the legs 23 and 24 must be spaced apart from the stationary contact 35. In addition, there must be no play of the operating shaft 27 when held in the pushed or pulled position.

The relationships among the legs 23 and 24, the stationary contact 35 and the cam 31 will be described in more detail with reference to FIGS. 12 to 15.

Figure 12:
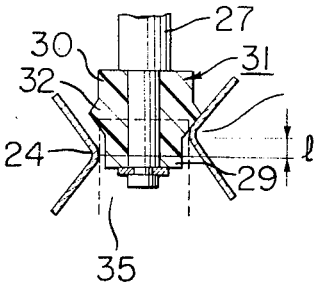
FIGS. 12 and 13 are views used to explain a first modification of the second embodiment.
Figure 13:
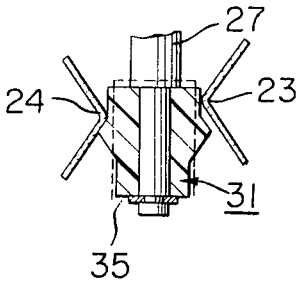

According to the arrangement as shown in FIGS. 12 and 13, with the operating shaft 27 in the pulled position the leg 24 is maintained in contact with the stationary contact 35 so that the switch is closed as shown in FIG. 12.

In the case of the second embodiment as shown in FIGS. 10 and 11, with the operating shaft 27 in the pushed position (the switch being opened), the inclined surface of the leg 24 of the movable contact member 22 tends to be made into contact with the tapered portion of the cam 31. Consequently, the gap between the leg 24 and the stationary contact 35 varies as the stroke between the pushed and pulled positions of the operating shaft 27 varies.

Figure 14:
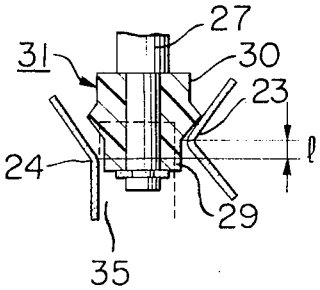
FIGS. 14 and 15 are views used to explain a second modification of the second embodiment.
Figure 15:
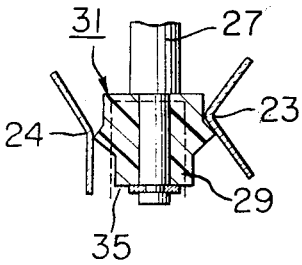

In a second modification as shown in FIGS. 14 and 15, the lower inclined surface of the V-shaped leg 24 which is made into contact with the stationary contact 35 with the operating shaft 27 in the pulled position is extended in parallel with the axis of the operating shaft 27 and hence the axis of the cam 31 and the axis of the stationary contact 35. Therefore, with the operating shaft 27 in the pushed position, a relatively wide gap can be maintained between the leg 24 and the stationary contact 35 as shown in FIG. 15. In addition, the variation in gap can be avoided even when variations in pushing stroke occur; that is, even when the pushed position of the operating shaft 27 and hence the cam 31 varies. Furthermore, with the operating shaft 27 in the pulled position, the leg 24 is made into contact with the stationary contact 35 with a relatively large contact area as shown in FIG. 14 so that the reliable and dependable electrical contact between them can be maintained.

Figure 16:
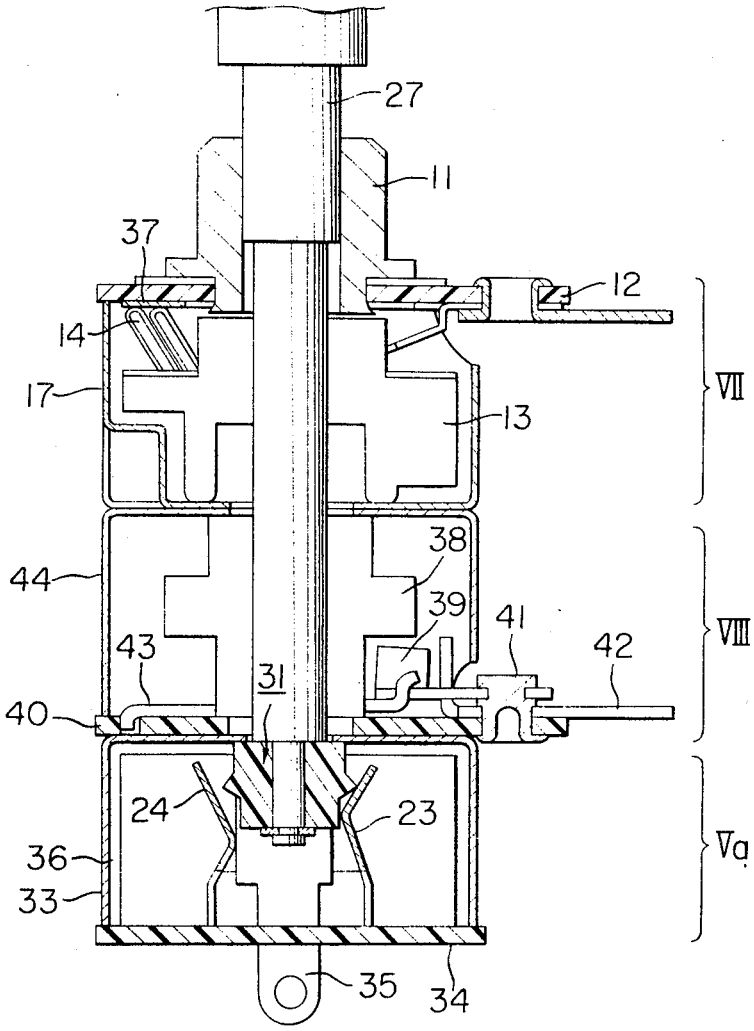
FIG. 16 is a longitudinal sectional view of the second embodiment of the present invention combined or ganged with a rotary switch.

In FIG. 16 is shown the second embodiment of the present invention in which a pull-push switch Va of the present invention is combined with a rotary switch VIII. Reference numeral 38 designates a switching cam securely fitted over the operating shaft 27 for rotation in unison therewith; 39, a movable contact rotatably supported by a rivet or the like 41 mounted on the base 40, the movable contact 39 being adapted for engagement with or disengagement from the adjacent end of a stationary contact 42; 43, a spring installed between the movable contact 39 and the base 40; and 44, a casing for the rotary switch VIII.

In summary, according to the present invention, the legs of the U-shaped elastic contact member have a double function of making into resilient contact with or moving away from the stationary contacts and clamping or locking the operating shaft in the pulled or pushed position. To put into another way, the switching mechanism and the locking mechanism are combined into a unitary construction. As a consequence, the number of parts can be reduced to a minimum and subsequently the fabrication and assembly steps can be reduced in number with the resulting reduction in cost. Furthermore, the pull-push switch can be made compact in size and light in weight.

When the edges of the legs of the movable contact member are staggered or misaligned vertically or axially as described with reference to FIGS. 10 to 15, the operating shaft can be positively maintained in its pulled or pushed position even when small vibration or impact is exerted to it.

In the case of the second modification as shown in FIGS. 14 and 15, the gap between the leg 24 and the stationary contact 35 can be maintained constant regardless of variations in pushed stroke of the operating shaft 27.

What is claimed is:

1. A pull-push switch comprising:

an operating shaft;

a U-shaped elastic movable contact fabricated by bending a leaf spring disposed astride said shaft;

a stationary contact disposed between the legs of said elastic contact;

a cam securely mounted on said operating shaft so as to be positioned between the legs of said elastic movable contact;

said cam having a small-diameter cylindrical portion and a large-diameter cylindrical portion spaced apart from each other by a predetermined distance in the axial direction, said small-diameter cylindrical portion and said large-diameter cylindrical portion are joined with each other through a tapered intermediate position;

said tapered intermediate portion comprises a first conically tapered portion and a second conically tapered portion; and the large-diameter bases of said first and second conically tapered portions are contiguous and the small-diameter bases of said first and second conically tapered portions are contiguous with the small- and large-diameter cylindrical portions, respectively;

whereby when said operating shaft is pulled or pushed so that said large-diameter cylindrical portion of said cam forces at least one of said legs of said elastic movable contact to bend outwardly away from said stationary contact, the switch is opened, but when said operating shaft is pushed or pulled so that said legs of said elastic movable contact spring back to rest on said small-diameter cylindrical portion of said cam, said legs are made into and maintained in contact with said stationary contact and consequently the switch is closed.

2. A pull-push switch as set forth in claim 1 further characterized in that each of said legs of said elastic movable contact is V-shaped in cross section so that the ridges of the V-shaped legs are made into contact with said cam on said operating shaft.

3. A pull-push switch as set forth in claim 2 further characterized in that the edges of said V-shaped legs of said elastic movable contact are spaced apart from each other by a predetermined distance in the axial direction of said operating shaft.

4. A pull-push switch as set forth in claim 3 further characterized in that said V-shaped legs of said elastic movable contact are so arranged that when they rest on said small-diameter cylindrical portion of said cam, one of them is brought into and maintained in contact with said stationary contact but the other is kept out of contact with said stationary contact.

5. A pull-push switch as set forth in claim 4 further characterized in that one of the two surfaces of said one V-shaped leg of said elastic movable contact which one surface is brought into contact with said stationary contact is extended in parallel with the axis of said operating shaft.

6. A pull-push switch as set forth in claim 1 further characterized in that one of said legs of said elastic movable contact is used as a stationary contact.

7. A pull-push switch as set forth in claim 1 further characterized in that said cam is mounted on said operating shaft in such a way that when said operating shaft is pushed, the switch is closed but when said operating shaft is pulled, the switch is opened.

* * * * *